US008997535B2

(12) United States Patent
Jeffries

(10) Patent No.: US 8,997,535 B2
(45) Date of Patent: Apr. 7, 2015

(54) LATCH ASSEMBLY

(75) Inventor: Mark Steven Jeffries, Buford, GA (US)

(73) Assignee: Austin Hardware and Supply, Inc., Lee's Summit, MO (US)

( * ) Notice: Subject to any disclaimer, the term of this patent is extended or adjusted under 35 U.S.C. 154(b) by 41 days.

(21) Appl. No.: 13/033,784

(22) Filed: Feb. 24, 2011

(65) Prior Publication Data

US 2011/0179839 A1 Jul. 28, 2011

Related U.S. Application Data

(60) Provisional application No. 61/309,315, filed on Mar. 1, 2010.

(51) Int. Cl.

| | |
|---|---|
| ***E05B 65/06*** | (2006.01) |
| ***E05B 59/00*** | (2006.01) |
| ***E05B 55/00*** | (2006.01) |
| ***E05B 63/14*** | (2006.01) |
| ***E05C 9/04*** | (2006.01) |

(52) U.S. Cl.
CPC ..... *E05C 9/042* (2013.01); *E05C 9/047* (2013.01)

(58) Field of Classification Search
CPC .... E05B 63/06; E05B 63/0017; Y10S 292/60
USPC ..... 70/418, 419, 134, 416, 107, 110, 150, 70/151 R, 151 A, 153, 483–485, 104, 108, 70/109, 118; 292/32, 33, 37, 42, 137, 138, 292/159, 169, 175, 140, 145, 35, 36, 41
See application file for complete search history.

(56) References Cited

U.S. PATENT DOCUMENTS

| | | | | | |
|---|---|---|---|---|---|
| 949,409 | A | * | 2/1910 | Badger | 292/32 |
| 2,307,038 | A | * | 1/1943 | Gutman | 292/167 |
| 2,848,263 | A | * | 8/1958 | Miller | 292/78 |
| 2,854,270 | A | * | 9/1958 | Ward | 292/169.14 |
| 3,622,187 | A | * | 11/1971 | Emery | 292/36 |
| 4,248,452 | A | * | 2/1981 | Allenbaugh | 292/167 |
| 4,509,347 | A | * | 4/1985 | Young | 70/129 |
| 4,602,490 | A | * | 7/1986 | Glass et al. | 70/134 |
| 4,662,665 | A | * | 5/1987 | Lin | 292/167 |
| 4,767,140 | A | * | 8/1988 | Lin | 292/337 |
| 4,777,810 | A | * | 10/1988 | Webster | 70/150 |
| 5,029,913 | A | * | 7/1991 | Wartian | 292/169 |
| 5,113,676 | A | * | 5/1992 | Panossian | 70/418 |
| 5,176,416 | A | * | 1/1993 | Lin | 292/143 |
| 5,317,890 | A | * | 6/1994 | Wu | 70/352 |
| 5,342,101 | A | * | 8/1994 | Shih | 292/165 |
| 5,378,029 | A | * | 1/1995 | Hoffeins | 292/30 |
| 5,509,703 | A | * | 4/1996 | Lau et al. | 292/1 |
| 5,551,264 | A | * | 9/1996 | Fann et al. | 70/134 |

(Continued)

*Primary Examiner* — Christopher Boswell
*Assistant Examiner* — Eric Kurilla
(74) *Attorney, Agent, or Firm* — Polsinelli PC

(57) ABSTRACT

A latch assembly is described. The latch assembly includes a casing. The latch assembly provides for the transfer of rotational force to translation plates. The rotational force drives translation plates and extends the translation plates from the latch assembly. A first translation plate is mechanically engaged to the casing. A second translation plate is mechanically engaged to the casing. The latch assembly includes a key assembly including a rotatable cam. A toggle cam is pivotally engaged to the casing via a pivot axle, and rotating the cam contacts the toggle cam to extend or retract both the first translation plate and the second translation plate from the casing.

16 Claims, 5 Drawing Sheets

(56) References Cited

U.S. PATENT DOCUMENTS

| | | | | |
|---|---|---|---|---|
| 5,570,913 | A * | 11/1996 | Puric | 292/36 |
| 5,794,991 | A * | 8/1998 | Smallegan et al. | 292/169 |
| 6,318,769 | B1 * | 11/2001 | Kang | 292/1.5 |
| 6,364,382 | B1 * | 4/2002 | Huang et al. | 292/336.5 |
| 6,443,503 | B1 * | 9/2002 | Fan Lu et al. | 292/1.5 |
| 6,622,535 | B2 * | 9/2003 | Chiang et al. | 70/107 |
| 6,871,884 | B2 * | 3/2005 | Hoffmann et al. | 292/39 |
| 6,964,183 | B2 * | 11/2005 | Keightley | 70/279.1 |
| 7,591,157 | B2 * | 9/2009 | O'Neill et al. | 70/118 |
| 7,607,701 | B2 * | 10/2009 | Levine | 292/163 |
| 7,703,815 | B2 * | 4/2010 | Berkseth et al. | 292/164 |
| 8,066,309 | B2 * | 11/2011 | Bartos | 292/337 |

* cited by examiner

LATCH ASSEMBLY

CROSS REFERENCE TO RELATED APPLICATION

This application claims the benefit of U.S. Provisional Patent Application No. 61/309,315 filed Mar. 1, 2010, which is hereby incorporated by reference.

FIELD OF INVENTION

The present invention relates to a latch assembly.

SUMMARY OF INVENTION

A latch assembly is described herein. The latch assembly provides for the transfer of rotational force to translation plates. The rotational force drives the translation plates and extends the translation plates from the latch assembly. The translation plates are attached, connected, or integral to locking systems such as, for example, rods, bolts, bars, throws, pins, etc., that lock or close a housing, such as, for example, a container, housing, locker, storage assembly, etc. The latch assembly is incorporated into the locking system of the housing, in order to lock and unlock the locking system in order open and close the housing.

A key and lock assembly provides the rotational forces that are transferred to the latch assembly. A rotatable cam is rotationally engaged to the lock assembly. By an operator manually turning the key, the rotatable cam is caused to rotate and to strike a toggle cam. The toggle cam is mechanically engaged to a first translation plate and a second translation plate. As the operator rotates the key, the toggle cam rotates, which extends and retracts both the first translation plate and the second translation plate, which move the locking system to lock and unlock the housing. As such, rotational movement of key is translated to linear movement, i.e., the extension and retraction, of the first and second translation plates.

In a further aspect, the key and lock assembly is replaced with an actuator, such as a knob, a handle assembly, lever, or the like, which causes the rotatable cam to rotate.

In a still further aspect, the latch assembly uses a short translation plate and a long translation plate. The toggle cam is mechanically engaged to the short translation plate and the long translation plate. As the operator rotates the key or the actuator, the toggle cam extends and retracts both the short translation plate and the long translation plate, which move the locking system to lock and unlock the housing. As such, rotational movement of the key or the actuator is translated to linear movement, i.e., the extension and refraction, of the first and second translation plates.

In a still further aspect, the latch assembly includes a casing, a long translation plate that extends and retracts from the casing, and a short translation plate that extends and retracts from the casing. The latch assembly includes a key assembly comprising a rotatable cam. A toggle cam is pivotally engaged to the casing via a pivot axle. The long translation plate includes a slot. The short translation plate includes a slot. The slots receive a drive rod that is in a pivotal engagement with the toggle cam. The rotatable cam contacts the toggle cam to extend or retract both the long translation plate and the short translation plate from the casing.

In a still further aspect, the latch assembly includes a casing, a first translation plate that is mechanically engaged to the casing, and a second translation plate that is mechanically engaged to the casing. The latch assembly includes an actuator comprising a rotatable cam, and rotating or twisting the actuator rotates the rotatable cam. A toggle cam is pivotally engaged to the casing via a pivot axle, and the rotatable cam contacts the toggle cam to extend or retract both the first translation plate and the second translation plate from the casing. The toggle cam includes a first cam surface and a second cam surface. The first cam surface includes an upper contact surface and a lower contact surface. The second cam surface includes an upper contact surface and a lower contact surface. The lower contact surface of the first cam surface has a beveled edge. The upper contact surface of the second cam surface has a beveled edge. A detent cam is in slideable engagement with the toggle cam. The rotatable cam rotates to contact the detent cam.

In a still further aspect, a method of assembling a latch assembly is provided. The method includes providing a latch assembly, comprising: a casing, a first translation plate, a second translation plate, wherein the casing comprises first and second detent positioning cut-outs, a toggle cam, wherein the toggle cam comprises a pivot axle opening and a drive rod opening, wherein the toggle cam comprises a detent cam in a spring-loaded, movable engagement with the toggle cam. The method further includes inserting the toggle cam, the detent cam, the first translation plate, and the second translation plate into the casing. The method further includes inserting a temporary pin through the first and second detent positioning cut-outs to temporarily fix a position of the detent cam. The method further includes installing a drive rod through an installation hole in the casing and a drive rod opening in the toggle cam. The method further includes removing the temporary pin, aligning the pivot axle opening of the toggle cam with a pivot axle hole in the casing, and installing a pivot axle through the pivot axle hole of the casing and the pivot axle opening of the toggle cam.

In a still further aspect, the latch assembly includes a casing, a first translation plate that extends and retracts from the casing, and a second translation plate that extends and retracts from the casing. The latch assembly includes an actuator comprising a rotatable cam, wherein rotating or twisting the actuator rotates the rotatable cam. A toggle cam is pivotally engaged to the casing via a pivot axle. The first translation plate includes a slot. The second translation plate includes a slot. The slots receive a drive rod that is in a pivotal engagement with the toggle cam. The rotatable cam rotates to contact the toggle cam to extend or retract both the first translation plate and the second translation plate from the casing.

DETAILED DESCRIPTION OF PREFERRED EMBODIMENTS

Figures 1, 2:
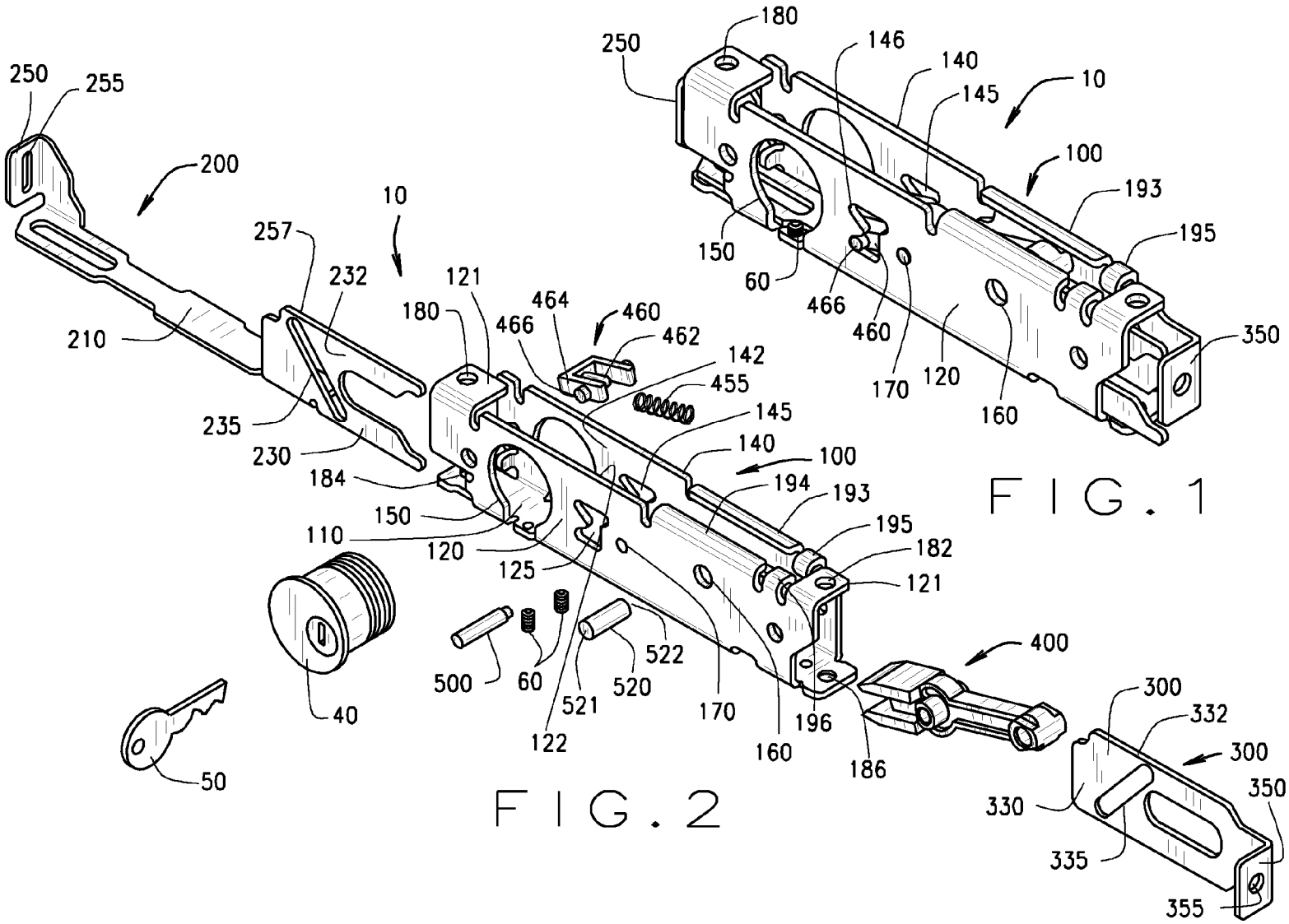
FIG. 1 is a perspective view of the latch assembly.
FIG. 2 is an exploded view of the latch assembly.

A latch assembly 10 will now be described with reference to the FIGURES. The latch assembly 10 comprises a casing 100, a first or long translation plate 200, a second or short translation plate 300, and a toggle cam 400. An exploded view of these components is shown in FIG. 1. The long translation plate 200 and the short translation plate 300 extend from the casing 100 to lock a locking system of a housing, and the long translation plate 200 and the short translation plate 300 withdraw into the casing 100 to unlock the locking system of the housing. For example, the long translation plate 200 and the short translation plate 300 may connect to lock bars of the locking system, which fixedly lock or unlock the housing.

Figure 3:
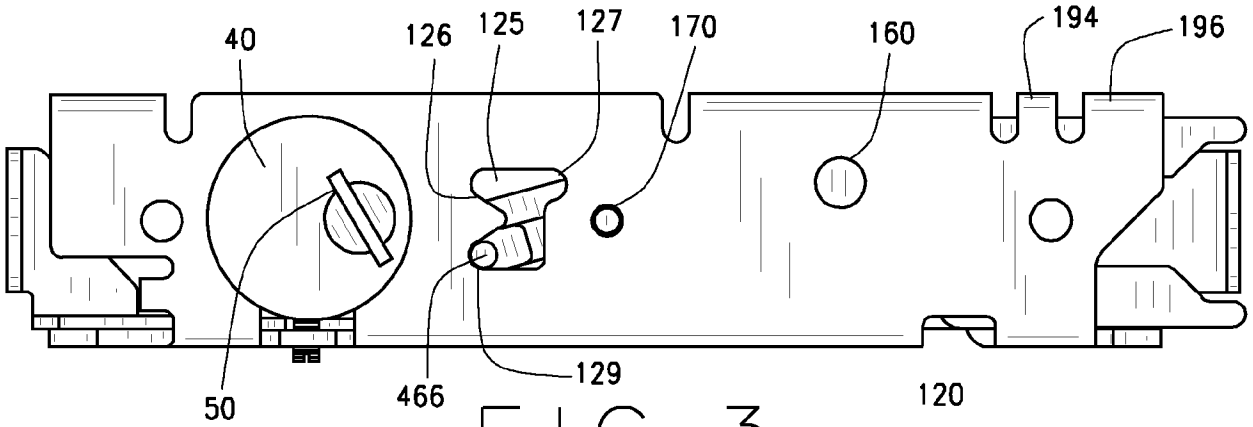
FIG. 3 is a side view of the latch assembly in a retracted position.
Figure 4:
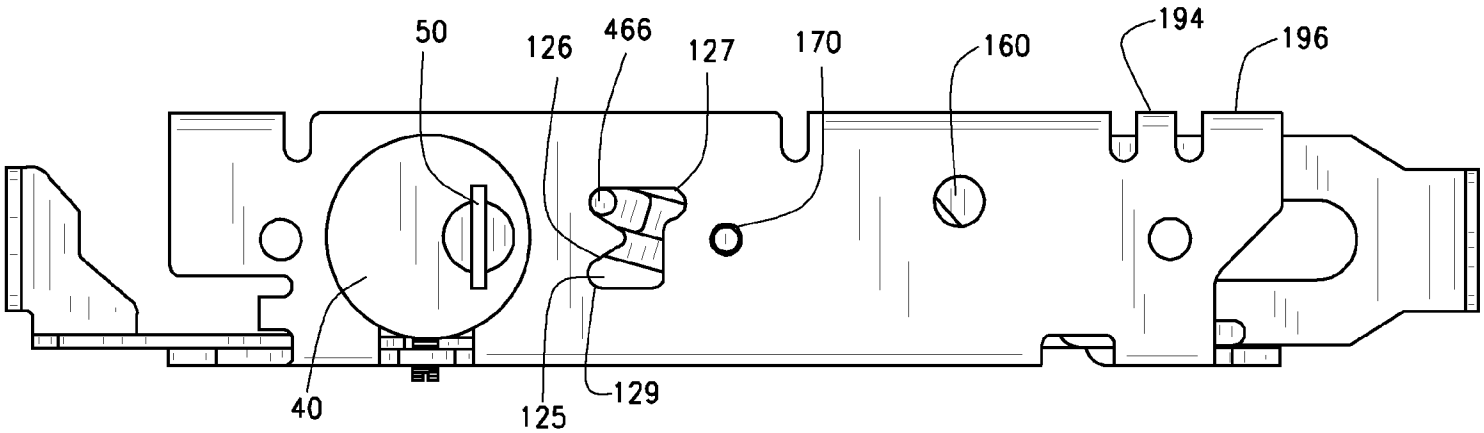
FIG. 4 is a side view of the latch assembly in an expanded position.
Figure 5:
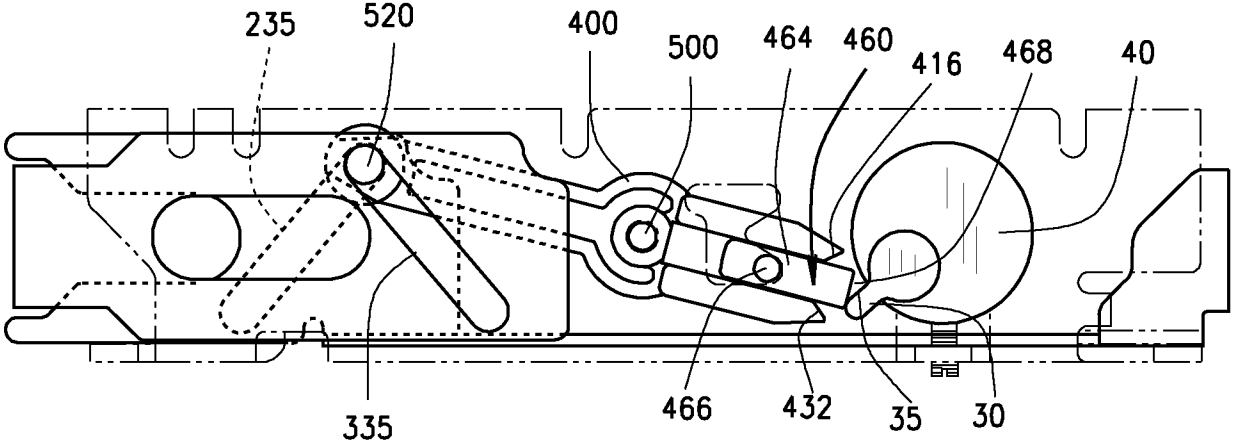
FIG. 5 is a view of the key and lock cylinder engaging the toggle cam.
Figure 6:
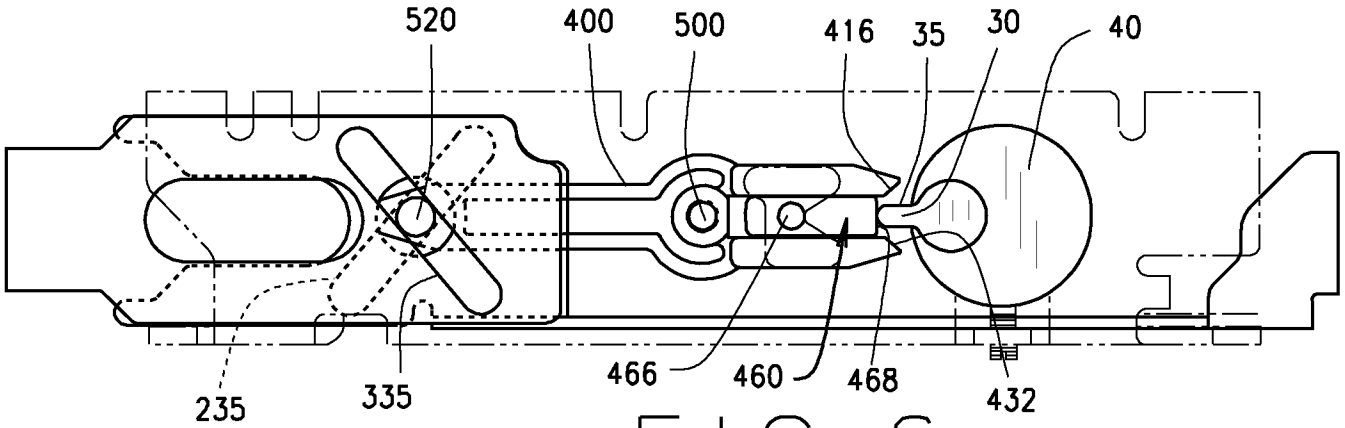
FIG. 6 is a view of the key and lock cylinder engaging the toggle cam.
Figure 7:
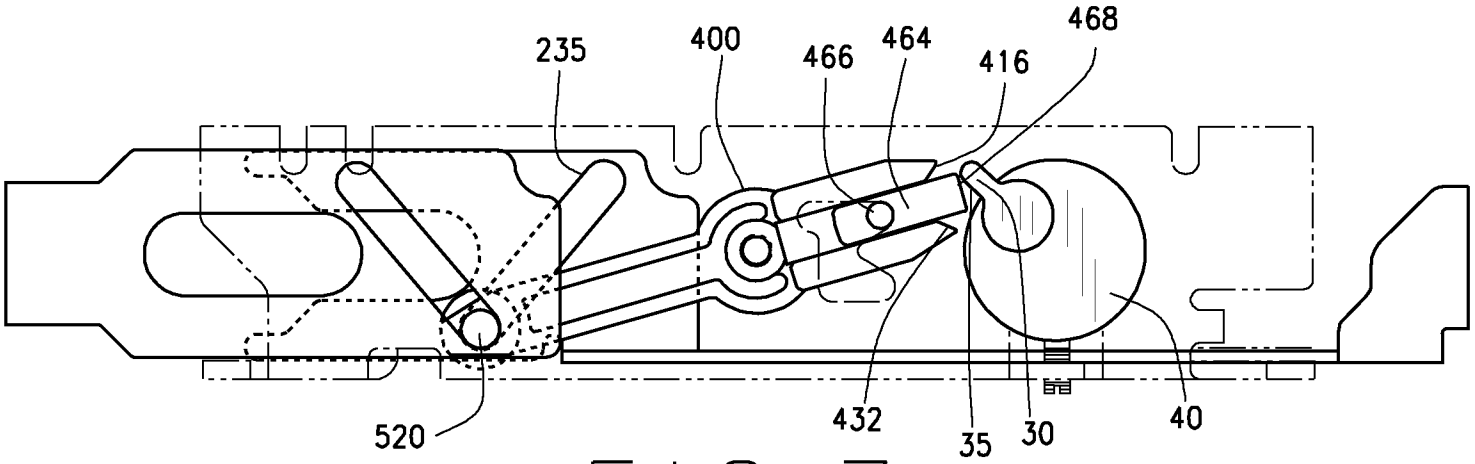
FIG. 7 is a view of the key and lock cylinder engaging the toggle cam.

The casing 100 defines a generally hollow or open interior 102 that receives the long translation plate 200, the short translation plate 300, and the toggle cam 400. The toggle cam 400 pivots within the interior 102 of the casing 100. The toggle cam 400 is pivotally engaged to the casing 100 via a pivot axle 500. The long translation plate 200 and the short translation plate 300 extend from the casing 100 as an operator turns a key 50. The key 50 is received by a lock cylinder 40. A rotatable cam 30 is rotatably engaged to the lock cylinder 40. As the key 50 is rotated, the rotatable cam 30 also rotates to contact or engage the toggle cam 400, which causes the long translation plate 200 and the short translation plate 300 to extend from the latch assembly 10. By turning the key 50 in an opposite direction, the long translation plate 200 and the short translation plate 300 retract into the latch assembly 10. A retracted view of the latch assembly 10 is shown in FIG. 3, while an extended view of the latch assembly 10 is shown in FIG. 4.

In other aspects, the key 50 is replaced with an actuator, such as a knob, handle assembly, lever, or the like, which causes the rotatable cam 30 to rotate. In certain applications, keyed access may not be required or necessary, and the actuator is used in place of the key 50. The actuator is rotatably engaged to the lock cylinder 40 and the rotatable cam 30. By turning the actuator, the rotatable cam 30 rotates and actuates the toggle cam 400. The rotating or twisting motion applied by the user to the key 50 or the actuator is translated to the rotatable cam 30.

The casing 100 generally includes a base portion 110, a first side portion 120, and a second side portion 140. The first side portion 120 and the second side portion 140 extend generally perpendicular to the base portion 110, while the first side portion 120 and the second side portion 140 are generally arranged parallel to each other.

The casing 100 receives both the long translation plate 200 and the short translation plate 300 in a slideable engagement. The casing 100 directs the extension and the retraction of the long translation plate 200 and the short translation plate 300.

The long translation plate 200 includes a bottom portion 210 and a side portion 230. The side portion 230 includes a side portion surface 232 that moves against an interior surface 122 of the first side portion 120 of the casing 100 during extension and retraction of the long translation plate 200 from the casing 100.

The short translation plate 300 includes a side portion 330. The side portion 330 includes a side portion surface 332 that slides against an interior surface 142 of the second side portion 140 of the casing 100 during extension and retraction of the short translation plate 300 from the casing 100. Any of the translation plates herein described may be formed as a one-piece, integral component. Further, any of translation plates herein described may be formed from multiple pieces that are welded, attached, snap-fit, or otherwise held together to form the translation plate.

In other embodiments, the long translation plate 200 and the short translation plate 300 are replaced with a first translation plate and a second translation plate that are the same size or are approximately the same size. The first translation plate and the second translation plate operate in the same general manner as described herein.

The casing 100 further includes a first detent positioning cut-out 125 in the first side portion 120. The casing 100 further includes a second detent positioning cut-out 145 in the second side portion 140. The first detent positioning cut-out 125 and the second detent positioning cut-out 145 direct movement of a detent cam 460. Specifically, detent cam protrusions 466 of the detent cam 460 slide against opening edges 126 of the first detent positioning cut-out 125 and opening edges 146 of the second detent positioning cut-out 145.

The casing 100 further includes a lock opening 150 that receives the lock cylinder 40. The lock opening 150 may pass through one or both of the first side portion 120 and the second side portion 140. The casing 100 further includes an installation hole 160 and a pivot axle hole 170.

The casing 100 further includes a first upper integral attachment hole 180 and a second upper integral attachment hole 182. Integral portions 121 of the first side portion 120 bend from the first side portion 120. The integral portions 121 bend approximately perpendicular to the first side portion 120. The upper integral attachment hole 180 and the second upper integral attachment hole 182 are positioned in the integral portions 121 over the interior 102 of the casing 100. The casing 100 further includes a first lower integral attachment hole 184 and a second lower integral attachment hole 186. The integral attachment holes 180, 182, 184, 186 provide for the latch assembly 10 to be fastened or affixed to a housing 20.

The long translation plate 200 includes an attachment portion 250 and an attachment opening 255 or stud. The attachment portion 250 may be bent generally perpendicular to the long translation plate 200. The attachment portion 250 may be connected to a further locking assembly. Likewise, the short translation plate 300 includes an attachment portion 350 and an attachment opening 355 or a stud that may be connected to a further locking assembly, and the attachment portion 250 may be bent generally perpendicular to the short translation plate 250.

The long translation plate 200 includes a slot 235, while the short translation plate 300 further includes a slot 335. These slots 235 and 335 receive a drive rod 520 that is in a mechanical and pivotal engagement with the toggle cam 400. The drive rod 520 directs the movement of the slots 235 and 335. The length and angle of the slots 235 and 335 determines the distance of extension or retraction of the translation plates 200 and 300. The drive rod 520 is generally aligned perpendicular to the first side portion 120 and the second side portion 140. The slots 235 and 335 define openings that are approximately 45 degrees relative to the lateral movement of the long translation plate 200 and the short translation plate 300 extending from the casing 100. As the drive rod 520 may travel in an arc, the slots 235 and 335 may also have a variety of shapes, including linear and non-linear shapes.

Figure 8:
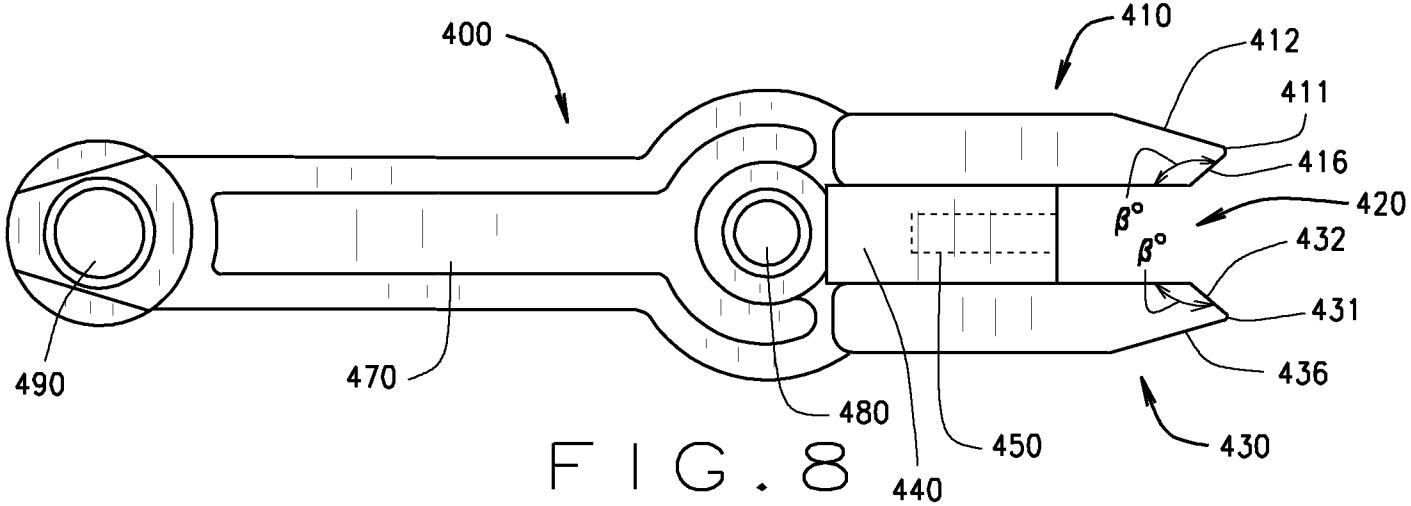
FIG. 8 is a view of the toggle cam.
Figure 9:
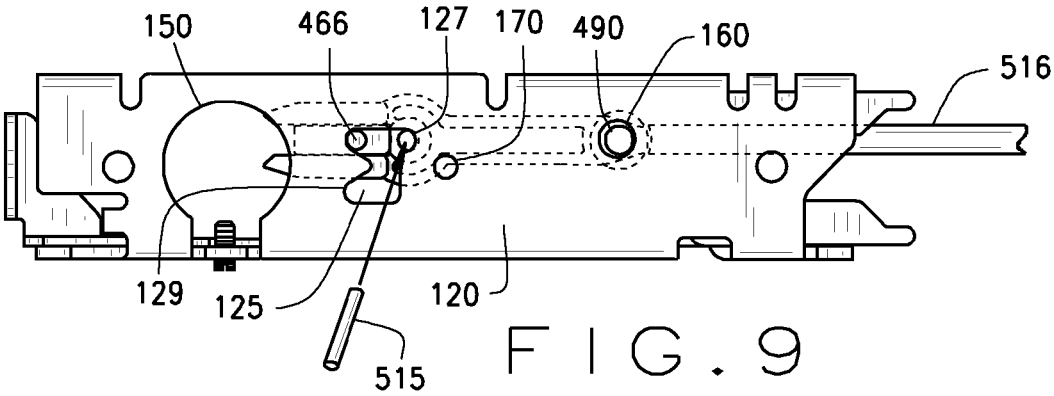
FIG. 9 is a view of the assembly step of the latch assembly where the temporary pin is placed.
Figure 10:
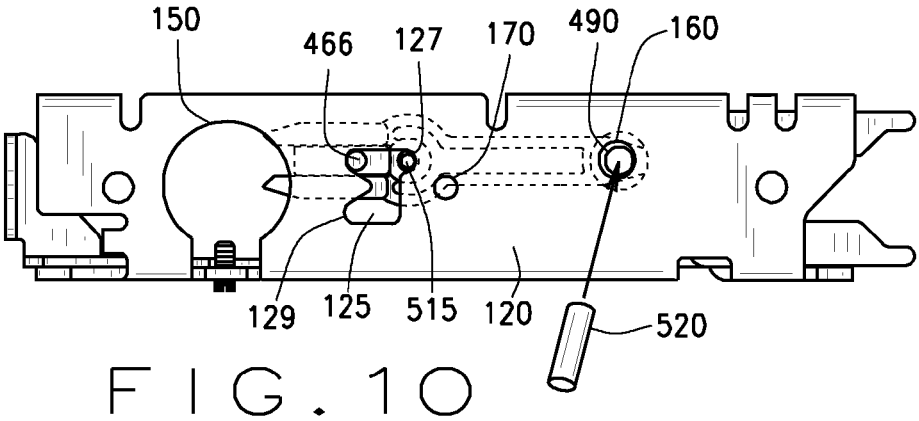
FIG. 10 is a view of the assembly step of the latch assembly where the drive rod is placed.
Figure 11:
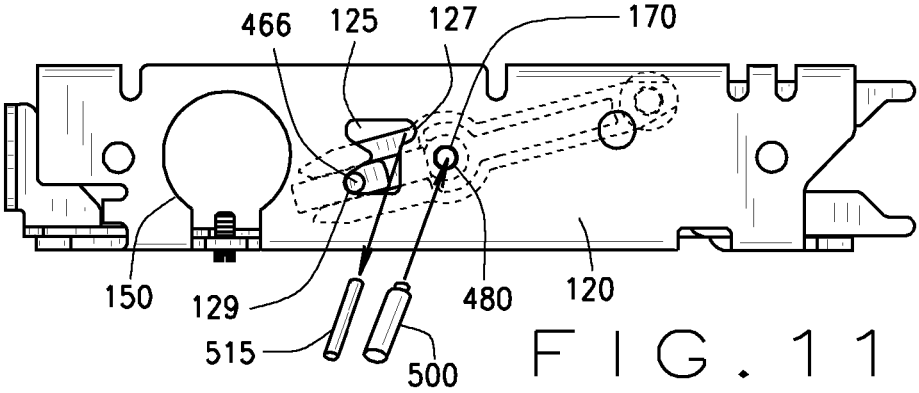
FIG. 11 is a view of is a view of the assembly step of the latch assembly where the pivot axle is placed.
Figure 12:
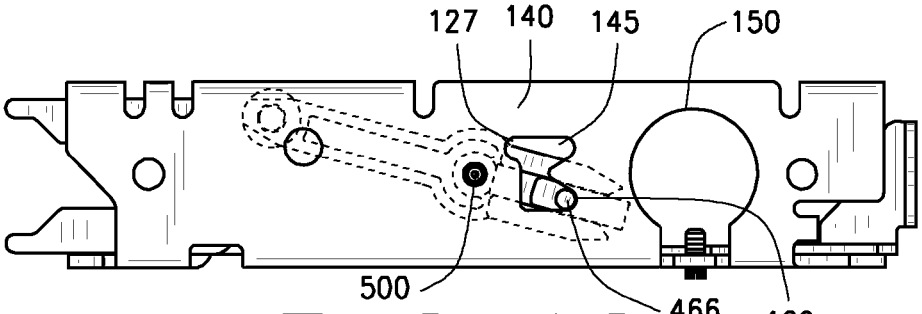
FIG. 12 is a view of the assembled latch assembly.

The toggle cam 400 will now be described with reference to FIG. 8. The toggle cam 400 includes a first cam surface 410 and a second cam surface 430. The first cam surface 410 includes an upper contact surface 412 and a lower contact surface 416. The second cam surface 430 includes an upper contact surface 432 and a lower contact surface 436. A cam opening 420 is provided between the first cam surface 410 and the second cam surface 430. The cam opening 420 provides a space to receive the detent cam 460 in a slideable engagement with the toggle cam 400.

The toggle cam 400 defines grooves 440 that receive lateral exterior portions 464 of the detent cam 460. The toggle cam 400 further defines a spring opening 450 that receives a spring 455. A rod 462 of the detent cam 460 is positioned interior of the spring 455, and the rod 462 may be urged into the spring opening 450 during the actuation of the toggle cam 400. The lateral exterior portions 464 further include detent cam protrusions 466 that are received by the first and second detent positioning cut-outs 125 and 145.

The toggle cam 400 further includes a pivot axle opening 480 and a drive rod opening 490. The pivot axle opening 480 receives the pivot axle 500 in pivoting engagement, while the drive rod opening 490 receives the drive rod 520. The pivot axle opening 480 is separated from the drive rod opening 490 by a cam rod 470.

In operation of the latch assembly 10, the operator turns the key 50, which causes the rotatable cam 30 to rotate. The rotatable cam 30 has a rotatable cam contact surface 35 that strikes or contacts the contact surface 468 of the detent cam 460 during the opening and closing movements of the latch assembly 10 caused by rotation of the key 50.

The rotatable cam 30 first contacts the contact surface 468 of the detent cam 460. As the detent cam 460 is spring-loaded by the spring 455, the detent cam 460 retracts into the toggle cam 400 between the first cam surface 410 and the second cam surface 430 when sufficient turning pressure is applied to the key 50. The retraction of the detent cam 460 into the cam opening 420 is guided by the interior surfaces of the first cam surface 410 and the second cam surface 430.

When the detent cam 460 retracts, the detent cam protrusions 466 are freed from the first detent positioning cut-out 125 and the second detent positioning cut-out 145. This allows the toggle cam 400 to rotate. As the rotatable cam 30 rotates, it contacts either the lower contact surface 416 or the upper contact surface 432 of the toggle cam 400, which causes the toggle cam 400 to rotate.

The drive rod 520 drives the movement of the slots 235 and 335. The drive rod 520 extends most of the interior width of the casing 100, and the drive rod 520 may contact one or both of the interior surface 122 and the interior surface 142. Ends 521 and 522 of the drive rod 520 slide against or in close proximity to the interior surface 122 and the interior surface 142.

The ends 521 and 522 are movably held in the slots 235 and 335. As the ends 521 and 522 of the drive rod 520 slide against or close to the interior surface 122 and the interior surface 142, the toggle cam 400 pivots about the pivot axle 500, which is fixed in the pivot axle opening 480. The drive rod 520 travels in an arc within the casing 100 to transfer the rotational force of the key 50 to the linear motion of the first translation plate 200 and the second translation plate 300. A width of the toggle cam 400 generally extends to the interior surfaces of the first translation plate 200 and the second translation plate 300. This aids the structural integrity of the latch assembly 10 and reduces wiggling or play of the translation plates 200 and 300.

The rotatable cam contact surface 35 also contacts the lower contact surface 416 of the first cam surface 410 and the upper contact surface 432 of the second cam surface 430. The lower contact surface 416 and the upper contact surface 432 are beveled to prevent binding of the lock assembly 10. As show in FIG. 8, the lower contact surface 416 of the first cam surface 410 has a beveled edge. Also, the upper contact surface 432 of the second cam surface 430 has a beveled edge. The first cam surface 410 terminates at a first cam point 411, while the second cam surface 430 terminates at a second cam point 431. Specifically, the upper contact surface 412 and the lower contact surface 416 join at the first cam point 411 at an angle β° as shown in FIG. 8 to form the beveled edge of the lower contact surface 416. The angle β may range from approximately 90° to approximately 170°. Likewise, the upper contact surface 432 and the lower contact surface 436 join at the second cam point 431 at the angle β to form the beveled edge of the upper contact surface 432.

The long translation plate 200 and the short translation plate 300 extend in opposite directions, i.e., the overall length of the latch assembly 10 is increased when the latch assembly 10 is actuated to the locked position. When moving to an open position, the latch assembly 10 retracts both the long translation plate 200 and the short translation plate 300. When moving to a closed position, the latch assembly 10 extends both the long translation plate 200 and the short translation plate 300, and the overall length of the latch assembly 10 is lengthened.

Guide surfaces 194 and 196 maintain the horizontal movement of the long translation plate 200. Specifically, an upper edge 237 of the side portion 230 may press against the guide surfaces 194 and 196. Likewise, an upper surface 337 of the side portion 330 is maintained by guide surfaces 193 and 195.

The casing 100, the long translation plate 200, the short translation plate 300 and the toggle cam 400 may be made from a variety of metal, plastics, and metal alloys such as zinc, steel, brass, iron and other steel alloys.

The latch assembly 10 provides the direct transfer of rotational force from rotation of the key 50, the actuator, or the like into a linear force that drives the long translation plate 200 and the short translation plate 300.

The translation plates 200 and 300 may interlock, connect or attach with locking rods and other types of locking systems and devices. The translation plates 200 and 300 form long bearing surfaces via the slots 235 and 335 that provide for smooth linear operation with less jiggle or internal movement.

The pivot axle 500 may be staked permanently into the casing 100 without the use of rings or other fasteners. This provides a flush outer surface to the casing 100. Set screws 60 may be used to position the lock cylinder 40 into the lock opening 150.

A method of assembling the latch assembly 10 will now be described. FIGS. 9-12 show the assembly of the latch assembly 10. The toggle cam 400, the detent cam 460, long translation plate 200, and the short translation plate 300 are inserted into the casing 100 with the use of a tool 516. The detent cam 460 is inserted into the first and second detent positioning cut-outs 125 and 145. Next, a temporary pin 515 is inserted through the first and second detent positioning cut-outs 125 and 145 at the notch 127 and the pivot axle opening 480 to temporarily fix a position of the detent cam 460. The drive rod 520 is inserted through the installation hole 160 in the casing 200, the slot 235, the drive rod opening 490 in the toggle cam 400, and the slot 335. The temporary pin 515 is removed.

Next, the pivot axle opening 480 of the toggle cam 400 is aligned with the pivot axle hole 170 in the casing 100. It is helpful to move the detent cam 460 to a lower portion 129 of the first and second detent positioning cut-outs 125 and 145 when aligning the pivot axle opening 480 and the pivot axle hole 170. The pivot axle 500 is installed through the pivot axle hole 170 of the casing 100 and the pivot axle opening 480 of the toggle cam 400. The pivot axle 500 may be staked into a chamfered area of the pivot axle hole 170 of the casing 100.

It should be understood from the foregoing that, while particular embodiments of the invention have been illustrated and described, various modifications can be made thereto without departing from the spirit and scope of the present invention. Therefore, it is not intended that the invention be limited by the specification; instead, the scope of the present invention is intended to be limited only by the appended claims.

What is claimed is:

1. A latch assembly, comprising:

a casing;

a long translation plate, wherein the long translation plate extends and retracts from the casing;

a short translation plate, wherein the short translation plate extends and retracts from the casing;

a key assembly comprising a rotatable cam;

a toggle cam pivotally engaged to the casing via a pivot axle; and, the long translation plate includes a slot that receives a first end of a drive rod, the short translation plate includes a slot that receives a second end of the drive rod, wherein the drive rod is in a pivotal engagement with the toggle cam, wherein the rotatable cam contacts the toggle cam to extend both the long translation plate and the short translation plate, in opposite directions, from the casing; and wherein the rotatable cam contacts the toggle cam to retract both the long translation plate and the short translation plate.

2. The latch assembly according to claim 1, wherein the toggle cam includes a first cam surface and a second cam surface, the first cam surface includes an upper contact surface and a lower contact surface, and the second cam surface includes an upper contact surface and a lower contact surface.

3. The latch assembly according to claim 2, further comprising a detent cam in slideable engagement with the toggle cam, wherein a cam opening is provided between the first cam surface and the second cam surface, and the cam opening provides a space to receive the detent cam.

4. The latch assembly according to claim 1, wherein the toggle cam includes a first cam surface and a second cam surface; the first cam surface includes an upper contact surface and a lower contact surface; the second cam surface includes an upper contact surface and a lower contact surface; wherein the lower contact surface of the first cam surface has a beveled edge; and the upper contact surface of the second cam surface has a beveled edge.

5. The latch assembly according to claim 1, wherein the casing comprises a base portion, a first side portion, and a second side portion that define an interior, wherein the first side portion and the second side portion extend generally perpendicular to the base portion.

6. The latch assembly according to claim 1, wherein the long translation plate includes a bottom portion and a side portion; the side portion of the long translation plate includes a side portion surface that moves against an interior surface of a first side portion of the casing during extension and retraction of the long translation plate from the casing; and the short translation plate includes a side portion, and the side portion of the short translation plates includes a side portion surface that slides against an interior surface of a second side portion of the casing during extension and retraction of the short translation plate from the casing.

7. The latch assembly according to claim 1, wherein the casing further includes a first upper integral attachment hole and a second upper integral attachment hole.

8. The latch assembly according to claim 1, wherein the casing further includes integral portions of a first side portion that bend from the first side portion, wherein the integral portions include a first upper integral attachment hole and a second upper integral attachment hole.

9. The latch assembly according to claim 1, wherein the casing further includes a first upper integral attachment hole and a second upper integral attachment hole over an interior of the casing.

10. The latch assembly according to claim 1, wherein the rotatable cam rotates to cause the toggle cam to rotate to extend or retract both the long translation plate and the short translation plate from the casing.

11. The latch assembly according to claim 1, wherein the rotatable cam rotates to cause the toggle cam to rotate and move the drive rod in the slots to extend or retract both the long translation plate and the short translation plate from the casing.

12. A latch assembly, comprising:

a casing;

a long translation plate, wherein the long translation plate extends and retracts from the casing;

a short translation plate, wherein the short translation plate extends and retracts from the casing;

a key assembly comprising a rotatable cam;

a toggle cam pivotally engaged to the casing via a pivot axle; and, the long translation plate includes a slot, the short translation plate includes a slot, and the slots receive a drive rod that is in a pivotal engagement with the toggle cam, wherein the rotatable cam contacts the toggle cam to extend both the long translation plate and the short translation plate, in opposite directions, from the casing; and wherein the rotatable cam contacts the toggle cam to retract both the long translation plate and the short translation plate, wherein the toggle cam comprises a detent cam, wherein the detent cam comprises lateral exterior portions, a rod, and a contact surface; and the lateral exterior portions comprise protrusions, wherein the toggle cam defines grooves that receive the lateral exterior portions of the detent cam; the toggle cam further comprises a spring opening that receives a spring; the rod of the detent cam is positioned interior of the spring, and the rod is urged into the spring opening during the actuation of the toggle cam.

13. The latch assembly according to claim 12, wherein the protrusions are received by first and second detent positioning cut-outs in a first side portion and a second side portion.

14. A latch assembly, comprising:

a casing;

a first translation plate, wherein the first translation plate is mechanically engaged to the casing;

a second translation plate, wherein the second translation plate is mechanically engaged to the casing;

an actuator comprising a rotatable cam, wherein rotating or twisting the actuator rotates the rotatable cam;

a toggle cam pivotally engaged to the casing via a pivot axle, wherein the rotatable cam contacts the toggle cam to extend or retract both the first translation plate and the second translation plate from the casing, wherein the first translation plate and the second translation plate extend from the casing in opposite directions, wherein the toggle cam includes a first cam surface and a second cam surface, the first cam surface includes an upper contact surface and a lower contact surface, the second cam surface includes an upper contact surface and a lower contact surface, wherein the lower contact surface of the first cam surface has a beveled edge, wherein the upper contact surface of the second cam surface has a beveled edge;

a detent cam in slideable engagement with the toggle cam, and wherein the detent cam retracts into the toggle cam; and, the rotatable cam rotates to contact the detent cam.

15. The latch assembly according to claim 14, wherein the first cam surface and the second cam surface form a cam opening, and the cam opening provides a space to receive the detent cam.

16. A latch assembly, comprising:

a casing;

a first translation plate, wherein the first translation plate extends and retracts from the casing;

a second translation plate, wherein the second translation plate extends and retracts from the casing;

an actuator comprising a rotatable cam, wherein rotating or twisting the actuator rotates the rotatable cam;

a toggle cam pivotally engaged to the casing via a pivot axle; and, the first translation plate includes a slot, the second translation plate includes a slot, a drive rod extends across a width of the casing, the slot of the first translation plate movably holds a first end of the drive rod, the slot of the second translation plate movable holds a second end of the drive rod, wherein the drive rod is in a pivotal engagement with the toggle cam; and wherein the rotatable cam rotates to contact the toggle cam to extend, in opposite directions, or retract both the first translation plate and the second translation plate from the casing.

* * * * *